US009705253B2

(12) United States Patent
Horiuchi

(10) Patent No.: US 9,705,253 B2
(45) Date of Patent: Jul. 11, 2017

(54) CONNECTOR

(71) Applicant: Sumitomo Wiring Systems, Ltd., Yokkaichi, Mie (JP)

(72) Inventor: Hidefumi Horiuchi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/194,620

(22) Filed: Jun. 28, 2016

(65) Prior Publication Data

US 2017/0025793 A1 Jan. 26, 2017

(30) Foreign Application Priority Data

Jul. 22, 2015 (JP) ..... 2015-144581

(51) Int. Cl.
*H01R 13/641* (2006.01)
*H01R 13/639* (2006.01)
*H01R 13/629* (2006.01)

(52) U.S. Cl.
CPC ..... *H01R 13/641* (2013.01); *H01R 13/62955* (2013.01)

(58) Field of Classification Search
CPC H01R 13/6272; H01R 13/641; H01R 13/638; H01R 13/6275
USPC ..... 439/352, 489
See application file for complete search history.

(56) References Cited

U.S. PATENT DOCUMENTS 6,068,507 A * 5/2000 Popa ..... H01R 13/641 439/352
6,712,635 B1 * 3/2004 Nimura ..... H01R 13/641 439/352
7,476,123 B2 * 1/2009 Kobayashi ..... H01R 13/4361 439/352
7,591,668 B2 9/2009 Nakamura
7,806,715 B2 * 10/2010 Zheng ..... H01R 13/6272 439/352
2002/0025711 A1 * 2/2002 Kashiyama ..... H01R 13/641 439/352
2003/0045161 A1 * 3/2003 Endo ..... H01R 13/641 439/489
2003/0157825 A1 * 8/2003 Kane ..... H01R 13/641 439/352
2004/0023547 A1 * 2/2004 Oka ..... H01R 13/6272 439/352

(Continued)

FOREIGN PATENT DOCUMENTS

JP 5119788 11/2012

*Primary Examiner* — Gary Paumen
(74) *Attorney, Agent, or Firm* — Gerald E. Hespos; Michael J. Porco; Matthew T. Hespos

(57) ABSTRACT

A connector is provided with a housing (10) including a lock arm (25) configured to hold a mating housing (90) in a connected state and a detector (60) to be assembled movably to a standby position and a detection position with respect to the housing (10). The lock arm (25) includes pressure receiving portions (33). The detector (60) includes pressing portions (69) configured to displace the lock arm (25) in a direction to increase a locking margin with a lock portion by pressing the pressure receiving portions (33) at least either when the detector (60) reaches the detection position or when an external force acts on the detector (60) in a direction opposite to a direction toward the standby position.

3 Claims, 13 Drawing Sheets

(56) References Cited

U.S. PATENT DOCUMENTS

| | | | | |
|---|---|---|---|---|
| 2009/0035980 | A1* | 2/2009 | Nakamura | H01R 13/641<br>439/352 |
| 2009/0170362 | A1* | 7/2009 | Nakamura | H01R 13/6272<br>439/352 |
| 2015/0111406 | A1* | 4/2015 | Okano | H01R 13/6272<br>439/352 |
| 2016/0072226 | A1* | 3/2016 | Puhl | H01R 13/6273<br>439/352 |

* cited by examiner

CONNECTOR

BACKGROUND

1. Field of the Invention

The invention relates to a connector.

2. Description of the Related Art

Japanese Patent No. 5119788 discloses a connector with a housing that can be connected to a mating housing. The housing has a resilient lock arm that engages a lock on a mating housing when the housing is connected properly to the mating housing. Thus, the lock arm and the lock regulate separation of the properly connected housing and mating housing. A detector is assembled with the housing for movement between a standby position and a detection position. The detector is configured to be held at the standby position until the two housings are connected properly and then is movable forward in a connecting direction of the housing from the standby position to the detection position. A locked state of the detector and the lock arm is maintained while the two housings are being connected so that a forward movement of the detector to the detection position is regulated. Thus, an inability to move the detector to the detection position indicates that the two housings are not connected properly. However, a forward external force applied to the detector at the detection position could press the lock arm forward and sufficiently away from the lock for backlash to occur between the two housings.

The present invention was completed based on the above situation and aims to provide a connector capable of preventing backlash between two housings in a connected state.

SUMMARY

The invention is directed to a connector with a housing including a lock arm configured to hold the housing and a mating housing by resiliently locking a lock on the mating housing when the housing is connected properly to the mating housing. A detector is assembled to the housing for movement between a standby position and a detection position. The detector is configured to be kept at the standby position until the two housings are connected properly, but can move to the detection position when the two housings are connected properly. The lock arm includes a pressure receiving portion, and the detector includes a pressing portion configured to displace the lock arm in a direction to increase a locking margin with the lock portion by pressing the pressure receiving portion at least when the detector reaches the detection position or when an external force acts on the detector in a direction opposite to a direction toward the standby position.

The pressing portion presses the pressure receiving portion after the two housings are connected. Thus, the lock arm is displaced in the direction to increase the locking margin with the lock. Accordingly, a locked state of the lock arm and the lock can be maintained satisfactorily and backlash between the two housings can be prevented.

At least one of the pressing portion and the pressure receiving portion may have an inclined surface inclined with respect to a moving direction of the detector and configured to displace the lock arm gradually in a direction to increase the locking margin with the lock by sliding on the other. Accordingly, the lock arm is displaced smoothly.

Two of the pressure receiving portions may be on opposite widthwise ends of the lock arm and two of the pressing portions may be on opposite widthwise ends of the detector, where the width direction is orthogonal to a connecting direction of the two housings. Accordingly, the lock arm is displaced in a balanced manner in the width direction.

DETAILED DESCRIPTION

Figure 1:
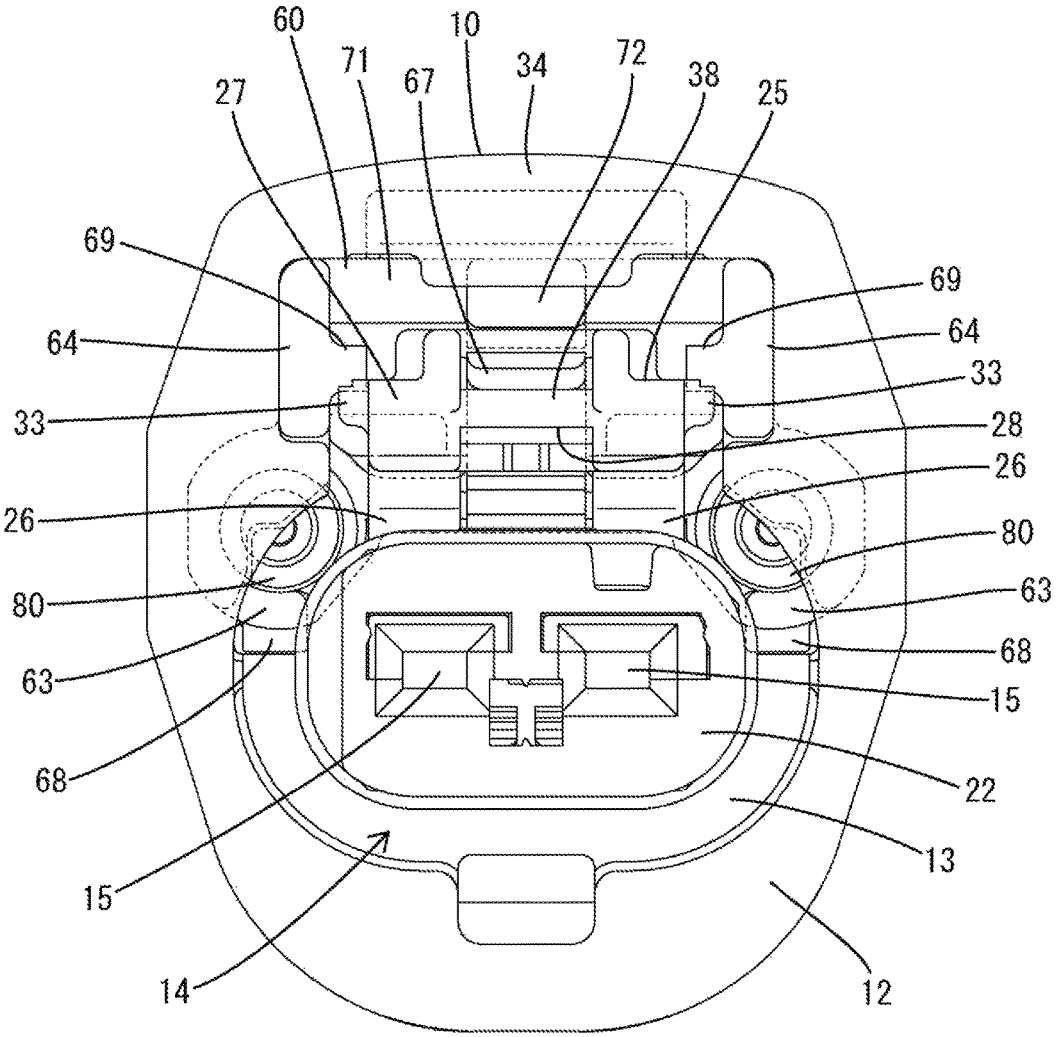
FIG. 1 is a front view of a connector of an embodiment of the invention.

An embodiment of the invention is described on the basis of FIGS. 1 to 14. A connector of this embodiment includes a housing 10 that is connectable to a mating housing 90. A detector 60 is assembled with the housing 10 and is movable between a standby position and a detection position. Biasing members 80 are mounted in the detector 60 and bias the detector 60 for movement to the detection position. In the following description, surfaces facing each other when the connection of the two housings 10, 90 is started are referred to as the front ends concerning a front-back direction, and a vertical direction is based on figures except FIGS. 8, 9 and 12. A width direction is synonymous with a lateral direction of FIGS. 1, 7, 10 and 11.

Figure 2:
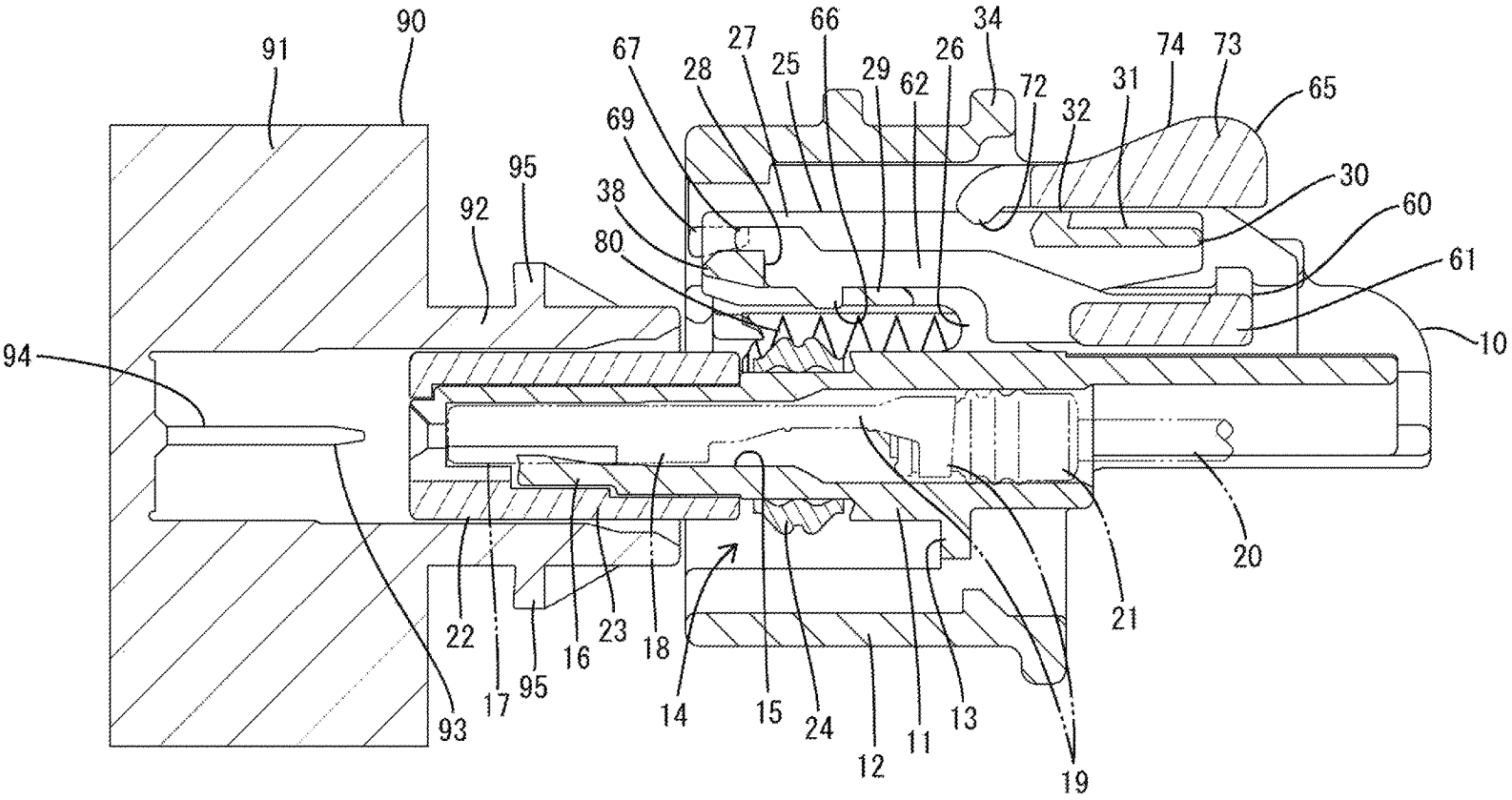
FIG. 2 is a section showing a state when the connection of two housings is started.

The mating housing 90 is made of synthetic resin and includes a device 91 and a tubular receptacle 92 directly connected to and projecting forward from the device 91, as shown in FIG. 2. Male tabs 94 of mating terminal fittings 93 project into the receptacle 92. The male tabs 94 paired in the width direction are arranged in the receptacle 92. Locks 95 project on outer surfaces of both upper and lower walls of the receptacle 92.

The housing 10 also is made of synthetic resin and, as shown in FIGS. 1 and 2, has a housing main body 11 that is long in the front-back direction. A fitting tube 12 surrounds the housing main body 11 and a coupling 13 couples the fitting tube 12 to the housing main body 11. A connection space 14 is open between the housing main body 11 and the fitting tube 12 at positions forward of the coupling 13 and can receive the receptacle 92 of the mating housing 90.

As shown in FIG. 2, cavities 15 extend through the housing main body 11 in the front-back direction at positions corresponding to the respective mating terminal fittings 93, and a locking lance 16 is cantilevered forward from the lower surface of an inner wall of each cavity 15. A terminal fitting 17 is inserted into each cavity 15 from behind.

The terminal fitting 17 is long and narrow in the front-back direction, as shown in FIG. 2. A tubular box 18 is formed in a front part of the terminal fitting 17 and an open barrel 19 is at a rear part. The male tab 94 of the mating terminal fitting 93 is inserted into the box 18 from the front to be connected. Further, the barrel 19 is crimped and connected to a core exposed at an end part of a wire 40 and a rubber plug 21 fit externally on the end of the wire 40. The locking lance 16 locks the box 18 when the terminal fitting 17 is inserted properly into the cavity 15. Thus, the terminal fitting 17 is held in the cavity 15 and the rubber plug 21 is inserted in a liquid-tight manner.

A cap-shaped front retainer 22 is mounted onto the housing main body 11 from the front, as shown in FIG. 2. The front retainer 22 is made of synthetic resin and includes regulating pieces 23 for regulating deflection of the locking lances 16 by entering deflection spaces for the locking lances 16 when the front retainer 22 is mounted properly onto the housing main body 11.

Figure 6:
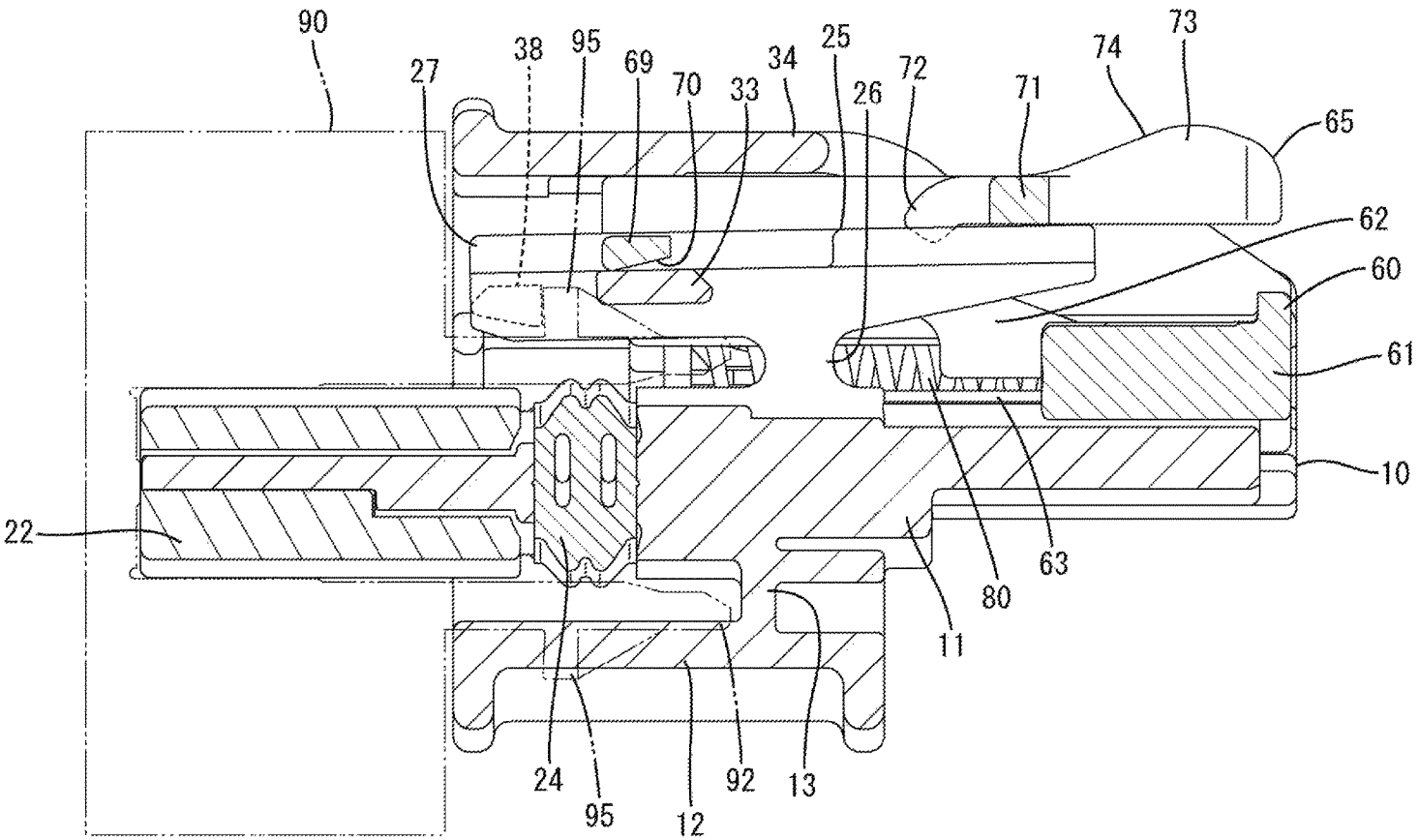
FIG. 6 is a section of the connector at a position corresponding to pressure receiving portions of a lock arm.

A seal ring 24 is fit before the coupling 13 on the outer peripheral surface of the housing main body 11, as shown in FIGS. 2 and 6. The seal ring 24 is positioned in the front-back direction between a step before the coupling 13 and the front retainer 22. The seal ring 24 is compressed resiliently between the housing main body 11 and the receptacle 92 when the housings 10, 90 are connected properly to provide liquid tight sealing between the two housings 10, 90.

Figure 9:
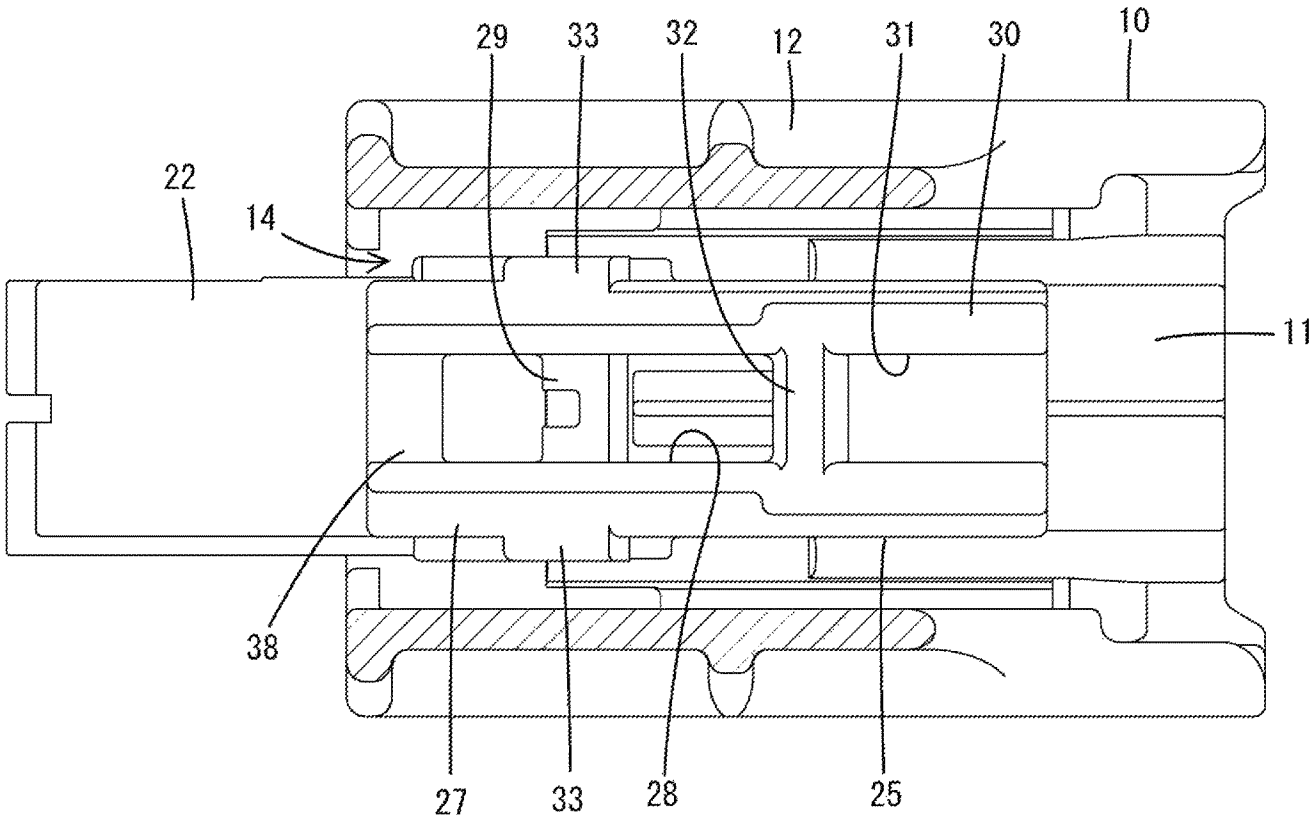
FIG. 9 is a plan view partly in section of the housing.

As shown in FIGS. 1, 2 and 9, a lock arm 25 is provided above the housing main body 11. The lock arm 25 is composed of two legs 26 standing up from the upper surface of the housing main body 11 and an arm main body 27 extending both forward and backward from the upper ends of the legs 26. This lock arm 25 is inclinable and resiliently displaceable in a seesaw manner with the legs 26 as supports.

As shown in FIGS. 2 and 9, the arm main body 27 is provided with a lock hole 28 extending in the front-back direction and open on the rear end. The lock hole 28 also includes a part open on both upper and lower surfaces of the arm main body 27 and is divided at opposite front and rear sides of a bottom wall 29 on the lower surface of the arm main body 27. A lock main body 38 is formed on a front end part of the arm main body 27 and extends in the width direction at a position forming the front end of the lock hole 28, as shown in FIG. 1.

Figure 7:
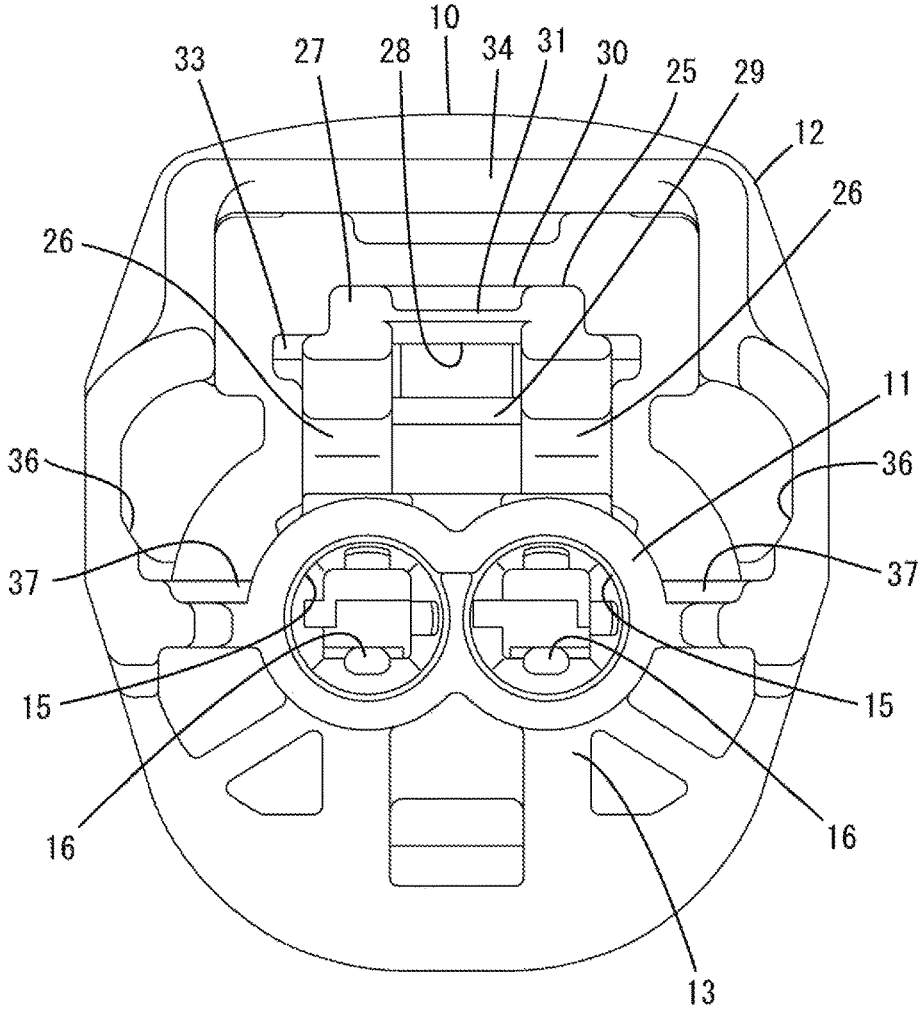
FIG. 7 is a rear view of the housing.

As shown in FIGS. 2, 7 and 9, a substantially rectangular plate 30 is provided on a rear part of the arm main body 27 at a position covering the lock hole 28 from above. A shallow recess 31 is provided on the upper surface of the plate 30. The recess 31 is substantially rectangular in a plan view and is open on the rear end of the arm main body 27. As shown in FIG. 2, the front surface of the recess 31 is tapered reversely to recede toward the upper side. A sliding surface 32 is formed on front part of the upper surface of the plate 30 forward of the recess 31 and a later-described resilient arm 65 of the detector 60 is slidable thereon. A front part of the sliding surface 32 is curved back and a rear part is a flat surface extending along the front-back direction.

Two pressure receiving portions 33 protrude on opposite widthwise end edges of the arm main body 27, as shown in FIG. 9. As shown in FIG. 6, the pressure receiving portions 33 are projecting pieces located before the legs 26 that are long in the front-back direction and can be pressed by later-described pressing portions 69 of the detector 60. The upper surfaces of the pressure receiving portions 33 are arranged substantially along the front-back direction.

Figure 8:
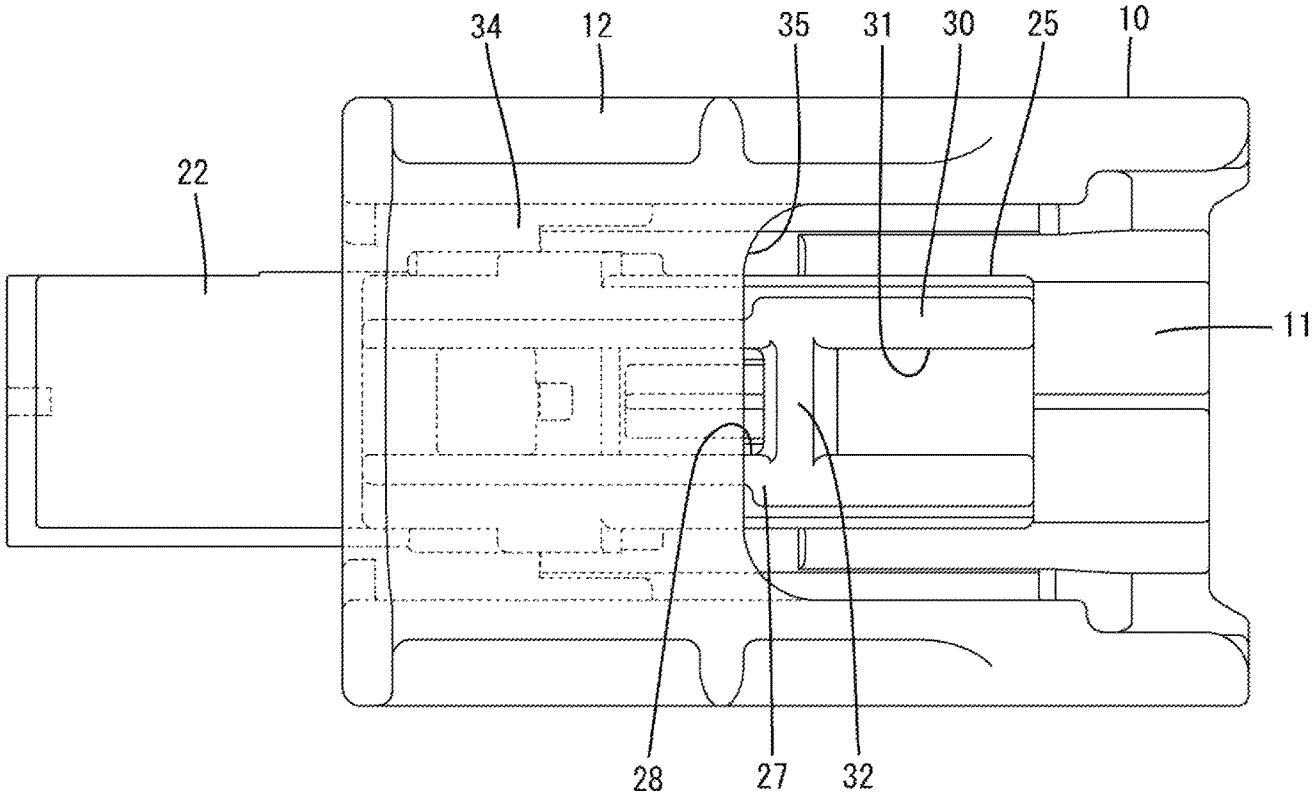
FIG. 8 is a plan view of the housing.

As shown in FIG. 8, a ceiling 34 is provided at a position covering a front part of the lock arm 25 in an upper part of the fitting tube 12. A rear side of the ceiling 34 is open as a cut portion 35 and a rear part of the lock arm 25 can be visually confirmed through the cut portion 35.

As shown in FIG. 7, substantially arcuate guide surfaces 36 are provided on the inner surfaces of opposite side parts of the fitting tube 12. Two stoppers 37 project at opposite widthwise sides of the lock arm 25 on the upper surface of the housing main body 11.

Figure 10:
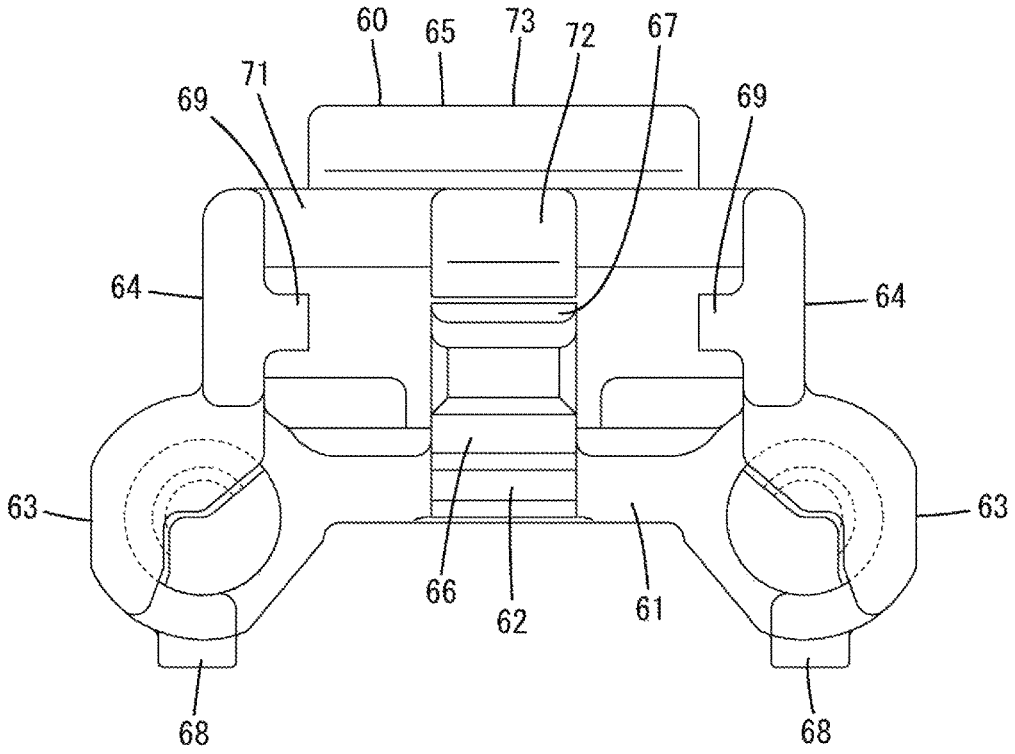
FIG. 10 is a front view of the detector.
Figure 11:
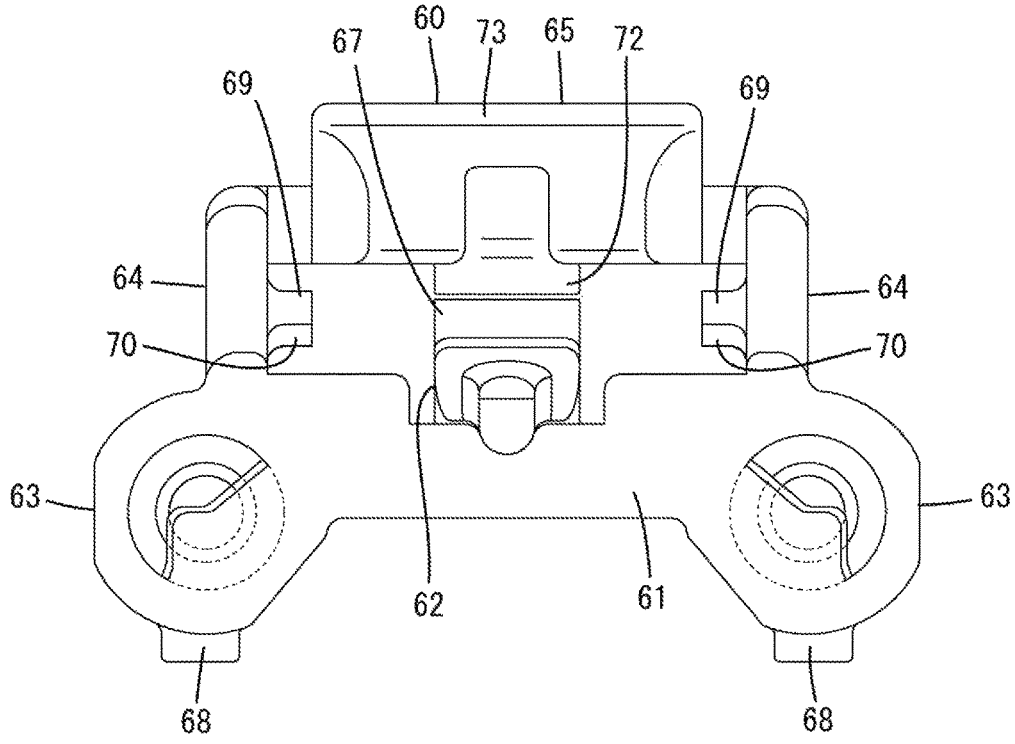
FIG. 11 is a rear view of the detector.
Figure 12:
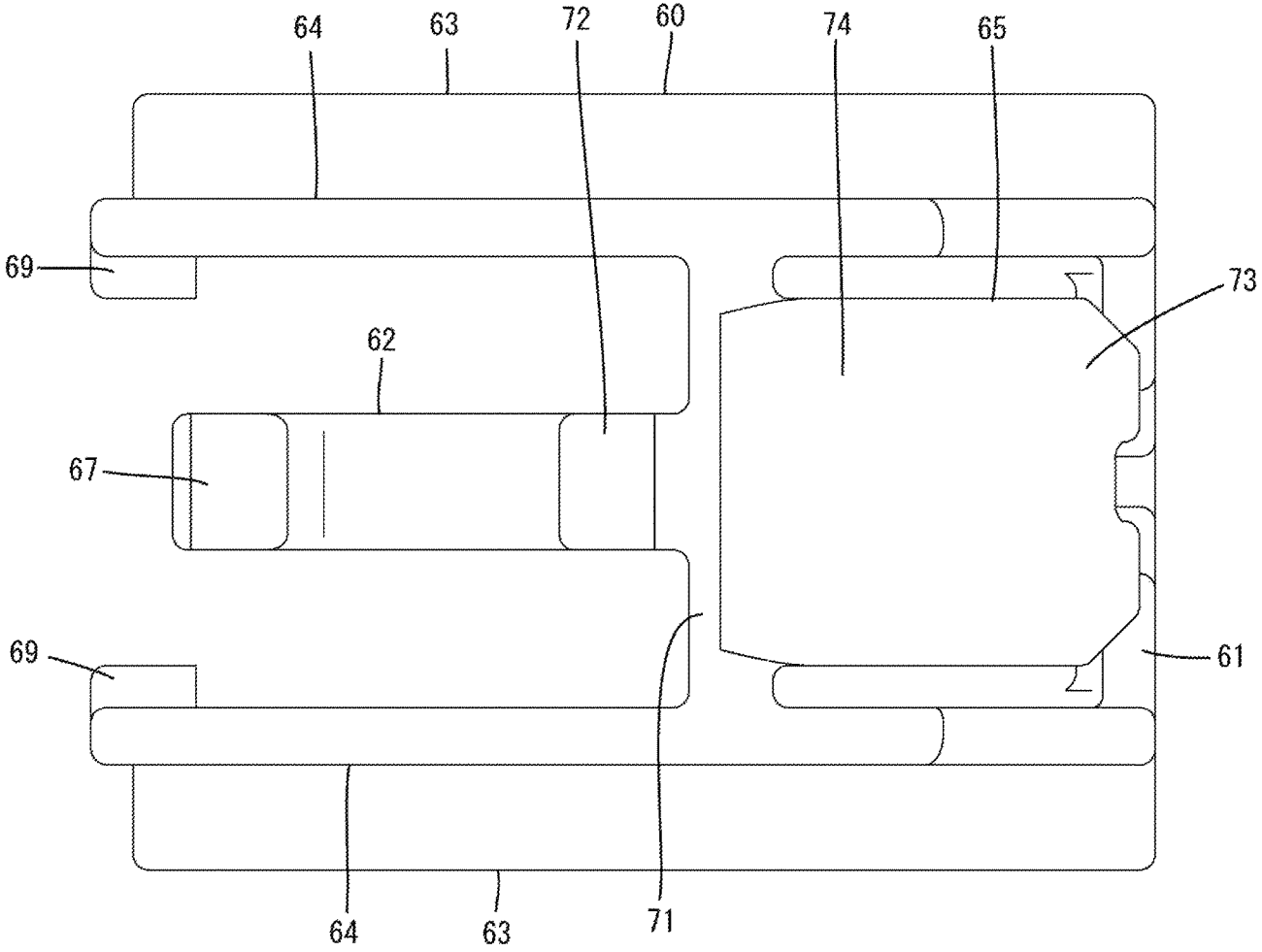
FIG. 12 is a plan view of the detector.

The detector 60 is made of synthetic resin and can be mounted from behind between the lock arm 25 and the housing main body 11. Specifically, as shown in FIGS. 10 to 12, the detector 60 includes a base 61 substantially in the form of a rectangular plate, a locking arm 62 projecting forward from a widthwise central part of the front end of the base 61, two forwardly projecting biasing member accommodating portions 63 connected to opposite widthwise ends of the base 61, two side plates 64 standing upward from the biasing member accommodating portions 63, and the resilient arm 65 coupled to the upper ends of rear parts of the side plates 64.

Figure 14:
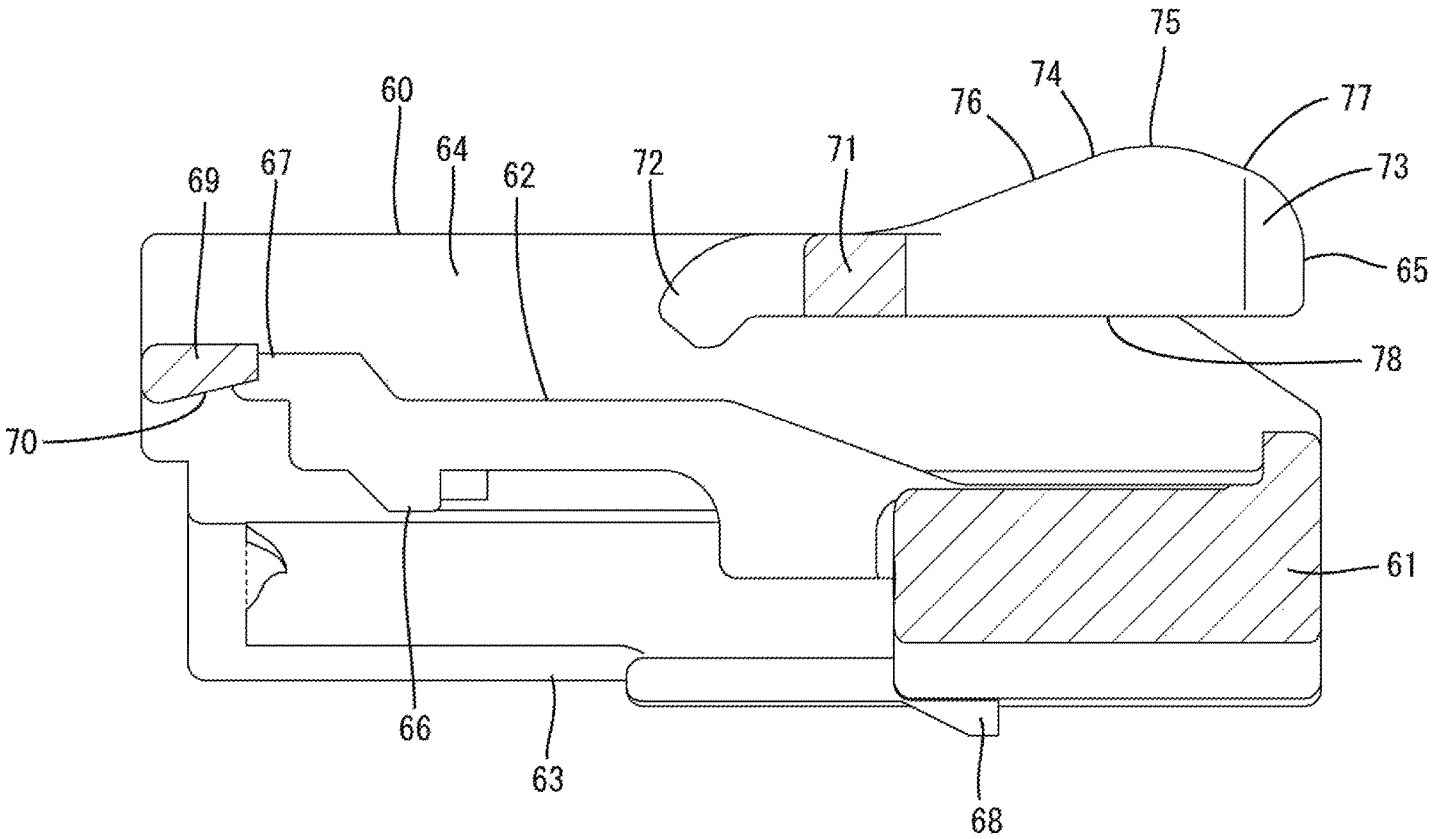
FIG. 14 is a section of the detector.

The locking arm 62 is a rectangular bar that is long and narrow in the front-back direction and is deflectable and deformable with the front end of the base 61 as a support. The locking arm 62 is insertable into the lock hole 28 of the lock arm 25 from behind. As shown in FIG. 14, a locking projection 66 projects down on a front part of the locking arm 62. Further, a projecting piece 67 stands up on the front end of the locking arm 62 and then projects forward.

The biasing member accommodating portions 63 have a partially cut cylindrical shape and are slidable along the guide surfaces 36 of the housing 10.

The biasing member 80 is a spring, such as a compression coil spring that is resiliently expandable and contractible in the front-back direction, and is accommodated in the biasing member accommodating portion 63, as shown in FIG. 6. The front end of the biasing member 80 can be pressed by the receptacle 92 in the process of connecting the two housings 10, 90. The rear end of the biasing member 80 is fixed to the rear wall of the biasing member accommodating portion 63.

Figure 13:
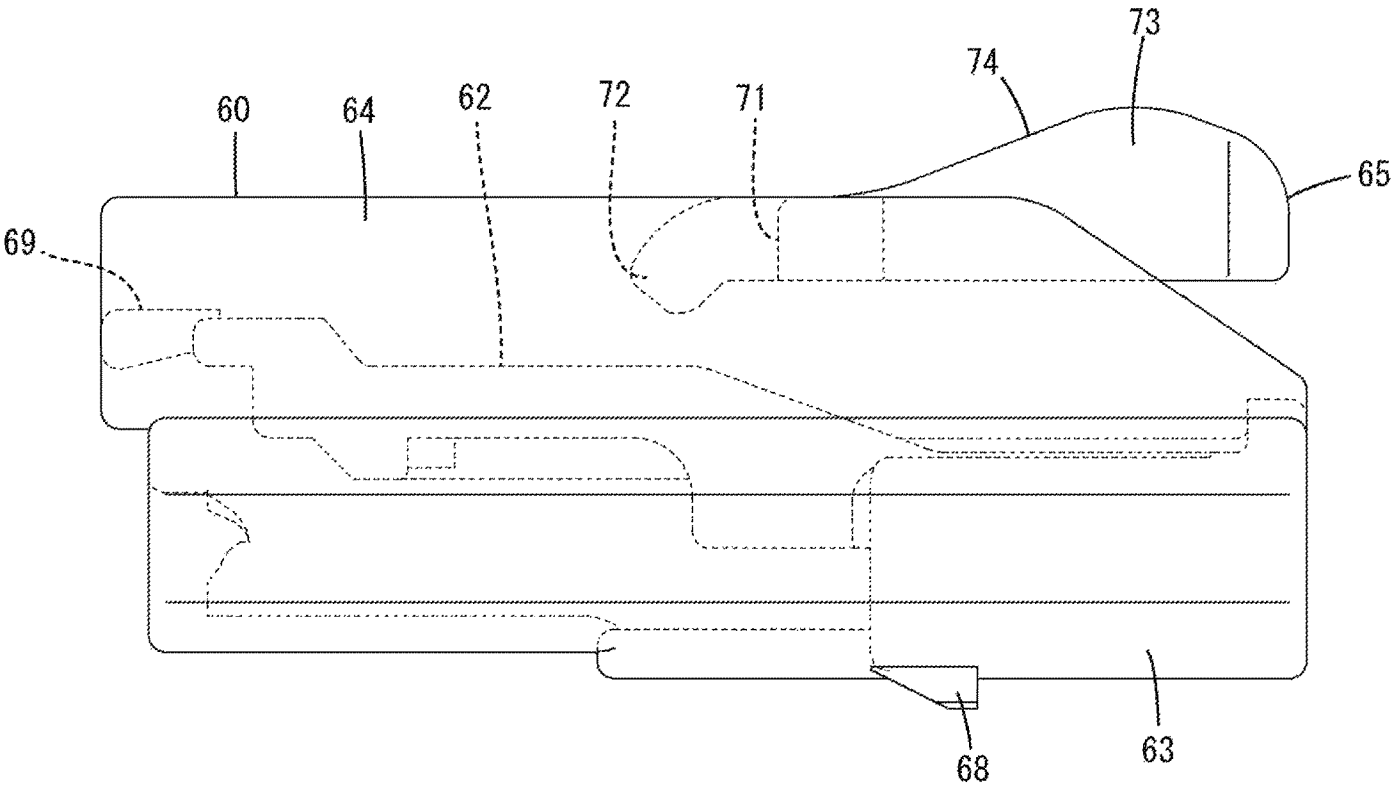
FIG. 13 is a side view of the detector.

As shown in FIGS. 10 and 13, claw-like retaining portions 68 project on the lower ends of the biasing member accommodating portions 63. The retaining portions 68 can contact the stoppers 37.

Two pressing portions 69 project on front parts of the inner surfaces of the side plates 64, as shown in FIGS. 10 and 12. The pressing portions 69 are blocks that are long in the front-back direction. As shown in FIG. 14, a tapered inclined surface 70 is provided on the lower surface of the pressing portion 69 and inclines moderately up toward the back. The pressing portion 69 is at a position vertically overlapping the pressure receiving portion 33 at the time of assembling and can press the pressure receiving portion 33 at the detection position, as shown in FIG. 6.

As shown in FIGS. 10 and 12, the resilient arm 65 is composed of a bridge 71 extending in the width direction and bridging between the upper ends of the side plates 64, an engaging portion 72 projecting forward from a widthwise central part of the bridge 71 and a wide operating portion 73 protruding back from the bridge 71. This resilient arm 65 is inclinable and resiliently displaceable in a seesaw manner in directions to move the engaging portion 72 vertically and the operating portion 73 with the bridge 71 as a support.

As shown in FIG. 14, the engaging portion 72 is a projecting piece inclined down toward the front from the bridge 71. The operating portion 73 is a thick member having a mountain-like cross-sectional shape. An operating surface 74 is formed on the top of the operating portion 73 and can be pressed when the detector 60 is moved from the detection position to the standby position. The operating surface 74 is composed of a curved top 75, a long tapered front slant 76 inclined down from the top 75 forward toward the bridge 71 and a curved and short rear slant 77 inclined down from the top 75 to the rear end. The operating surface 74 (front slant 76, top 75 and rear slant 77) defines a curved surface and extends smoothly and continuously without forming a step. A flat surface 78 is formed on the bottom of the operating portion 73 and extends along the front-back direction.

The detector 60 is assembled with the housing 10 from behind. The locking projection 66 is fit resiliently into the lock hole 28 in front of the bottom wall 29 when the detector 60 reaches the standby position. Additionally, the bridge 71 and the operating portion 73 of the resilient arm 65 cover the plate 30 from above and the engaging portion 72 of the resilient arm 65 is in front of and at a distance from the plate 30 (see FIG. 2). Further, the pressing portions 69 are in front of and at a distance from the pressure receiving portions 33 at the standby position, and the projecting piece 67 is supported in contact with the lock main body 38 of the lock arm 25 from above. The biasing members 80 are in a slightly contracting state in the biasing member accommodating portions 63.

Figure 3:
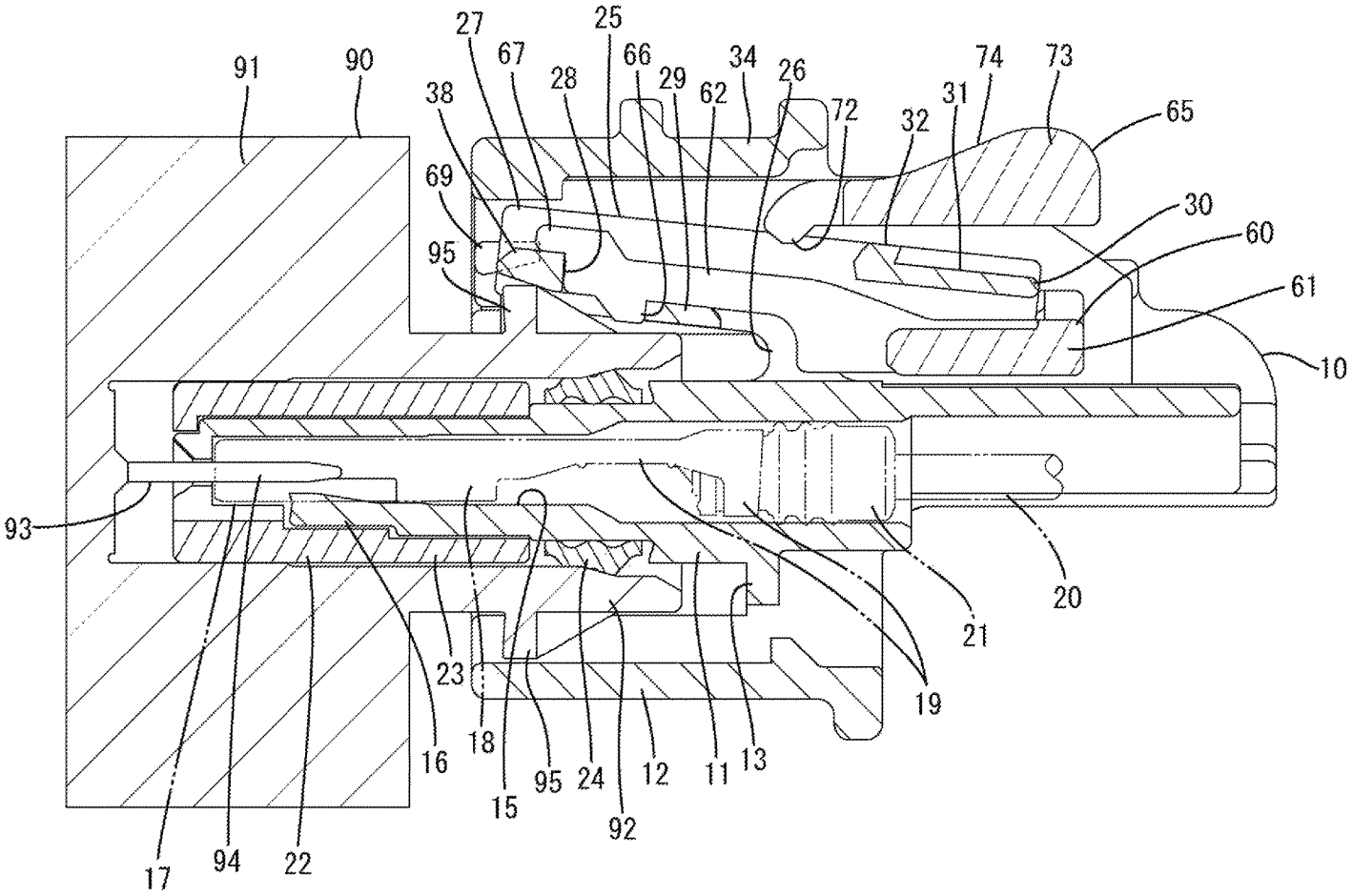
FIG. 3 is a section showing an intermediate state while the housings are being connected.

Subsequently, the housing main body 11 is fit into the receptacle 92. An opening end of the receptacle 92 contacts the front ends of the biasing members 80. As the connection progresses, the biasing members 80 are pressed by the receptacle 92 to contract and to accumulate biasing forces. Further, as shown in FIG. 3, the lock main body 38 of the lock arm 25 moves onto the lock 95 so that the lock arm 25 is deflected. During this time, the locking projection 66 remains fit in the lock hole 28 before the bottom wall 29 and the locking arm 62 deflects to follow the lock arm 25.

Figure 4:
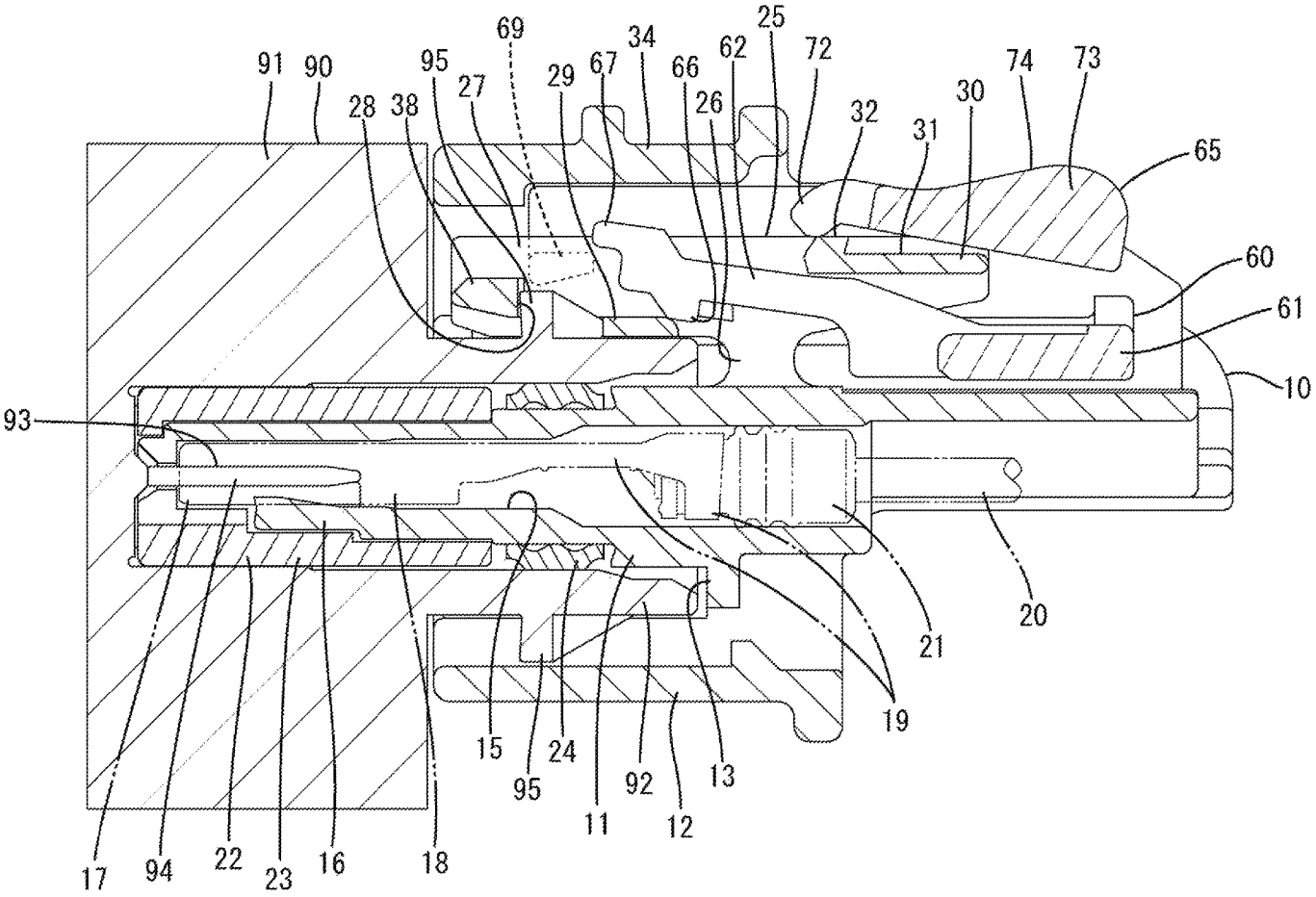
FIG. 4 is a section showing an intermediate state while a detector is moving toward a detection position after the two housings are connected properly.

The lock 95 enters the lock hole 28 forward of the bottom wall 29 when the two housings 10, 90 reach a proper connection position and the locking projection 66 is pressed by the lock 95 to be released from locking with the bottom wall 29, as shown in FIG. 4. Additionally, the biasing members 80 release the biasing forces and extend so that the entire detector 60 is moved back.

At the time of moving the detector 60 back, the biasing member accommodating portions 63 slide on the guide surfaces 36, the base 61 slides on the upper surface of the housing main body 11 and the detector 60 is moved to the detecting position. Further, as shown in FIG. 4, the locking projection 66 slides on the upper surface of the bottom wall 29 to maintain a deflected state of the locking arm 62. A tip of the engaging portion 72 slides on the sliding surface 32 of the plate 30 immediately before the detector 60 reaches the detection position and the resilient arm 65 is deflected and deformed in a seesaw manner. This sliding movement of the resilient arm 65 on the sliding surface 32 generates a sliding resistance between the detector 60 and the lock arm 25 to decelerate a moving speed of the biasing members 80 toward the detection position.

The biasing members 80 return to a substantially natural state when the detector 60 reaches the detection position. Additionally, the locking arm 62 resiliently returns to fit the locking projection 66 into the lock hole 28 behind the bottom wall 29 and the resilient arm 65 resiliently returns to fit the engaging portion 72 into the recess 31 of the plate 30, as shown in FIG. 5.

The retaining portions 68 are stopped in contact with the stoppers 37 when the detector 60 reaches the detection position. At this time, sliding resistance caused by the resilient arm 65 slows the moving speed of the detector 60 to alleviate an impact when the retaining portions 68 are stopped.

The inclined surfaces 70 of the pressing portions 69 slide on the pressure receiving portions 33 from a moment immediately before the detector 60 reaches the detection position to press the pressure receiving portions 33 down. Thus, the lock arm 25 inclines slightly down toward the front (see FIG. 6). In this way, the lock 95 is inserted deeper into the lock hole 28. If an external pulling force acts on the detector 60 in a direction to separate the detector 60 from the housing 10 in this state, the pressing portions 69 slide farther on the pressure receiving portions 33 and the lock arm 25 is deflected farther and deformed in a direction to increase a locking margin of the lock main body 38 and the lock 95. As a result, a clearance between the lock arm 25 and the lock portion 95 is narrowed to suppress backlash between the two housings 10, 90.

Figure 5:
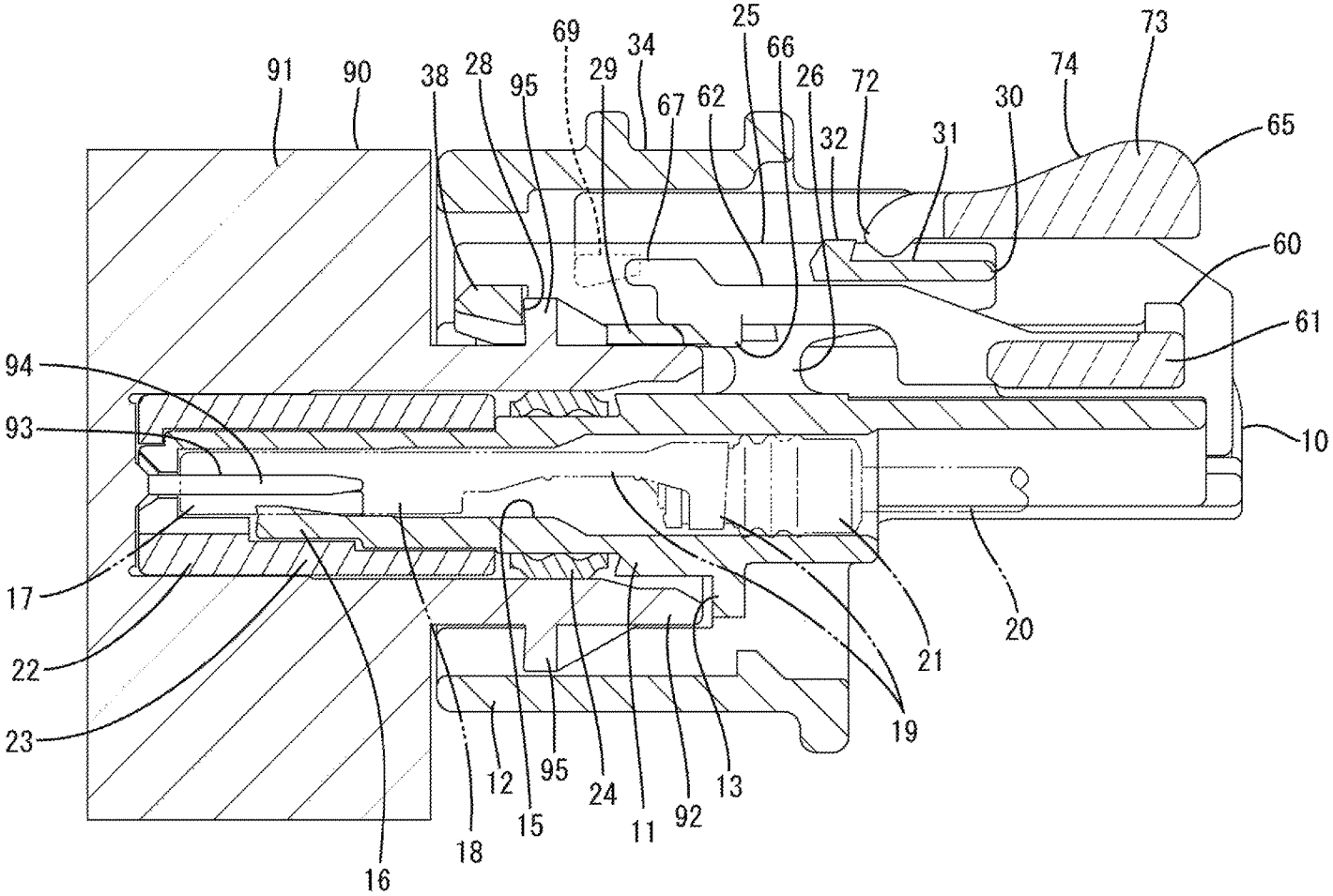
FIG. 5 is a section showing a state where the detector has reached the detection position after the housings are connected properly.

Movement of the detector 60 from the detection position to the standby position is regulated by the insertion of the engaging portion 72 into the recess 31, as shown in FIG. 5. Accordingly, if the operating surface 74 of the operating portion 73 is pressed down, the arm 65 is deflected and deformed in a seesaw manner and the engaging portion 72 exits the recess 31. If the operating surface 74 of the operating portion 73 is pressed forward in that state, the detector 60 is moved forward against the biasing forces of the biasing members 80 to reach the standby position.

As described above, when the detector 60 reaches the detection position and when an external force acts in a direction to move the detector 60 farther back from the detection position after the two housings 10, 90 are connected, the pressing portions 69 press the pressure receiving portions 33, and the lock arm 25 is displaced in the direction to increase the locking margin with the lock 95. Thus, the locked state of the lock arm 25 and the lock 95 can be maintained satisfactorily and backlash between the two housings 10, 90 can be prevented.

Further, the inclined surfaces 70 of the pressing portions 69 slide on the pressure receiving portions 33 so that the lock arm 25 is displaced smoothly. Furthermore, the pressure receiving portions 33 are on the opposite widthwise sides of the lock arm 25 and the pressing portions 69 are on the opposite widthwise sides of the detector 60. Thus, the lock arm 25 is displaced in a manner balanced in the width direction.

The resilient arm 65 slides on the sliding surface 32 of the lock arm 25 while being resiliently deformed as the detector 60 moves to the detection position. Thus, the moving speed of the detector 60 is slowed and an impact of the detector 60 reaching the detection position can be alleviated. As a result, the housing 10 will not be damaged.

The resilient arm 65 slides smoothly on the sliding surface 32 shortly before the detector 60 reaches the detection position. Furthermore, the resilient arm 65 includes both the engaging portion 72 for keeping the detector 60 at the detection position and the operating surface 74 to be pressed when the detector 60 is moved to the standby position. Thus, functions are concentrated on the resilient arm 65, and the entire configuration can be simplified.

The operating surface 74 of the operating portion 73 is a step-free curved surface so that wires 40 and the like are unlikely to be caught by the operating surface 74 and locking of the resilient arm 65 and the recess 31 is not released inadvertently. As a result, the detector 60 will not be moved accidentally to the standby position.

Other embodiments are briefly described below.

The sliding surface on which the resilient arm slides may be provided on a part of the housing other than the lock arm.

The lock arm may be deflected and deformed in the direction to increase the locking margin with the lock only when the detector reaches the detection position or only when an external force acts on the detector in the direction opposite to the direction toward the standby position.

The inclined surfaces may be provided not only on the pressing portions, but also on the pressure receiving portions. Further, the inclined surfaces may be provided only on the pressure receiving portions without being provided on the pressing portions.

The detector may be configured to move forward from the standby position to the detection position.

The biasing member may be mounted across between the housing and the detector by having one end supported on the housing and the other end supported on the detecting member.

LIST OF REFERENCE SIGNS

10 . . . housing
11 . . . housing main body
25 . . . lock arm
31 . . . recess
32 . . . sliding surface
33 . . . pressure receiving portion
60 . . . detector
62 . . . locking arm
65 . . . resilient arm
69 . . . pressing portion
70 . . . inclined surface
74 . . . operating surface
80 . . . biasing member
90 . . . mating housing
95 . . . lock

What is claimed is:

1. A connector, comprising:

a housing including a lock arm configured to hold the housing and a mating housing by resiliently locking a lock provided on the mating housing when the housing is connected properly to the mating housing; and a detector to be assembled movably to a standby position and a detection position with respect to the housing and configured to be kept at the standby position until the two housings are connected properly and be movable to the detection position as the two housings connected properly;

wherein:

the lock arm includes a pressure receiving portion; and the detector includes a pressing portion configured to displace the lock arm in a direction to increase a locking margin with the lock by pressing the pressure receiving portion at least when the detector reaches the detection position or when an external force acts on the detector in a direction opposite to a direction toward the standby position.

2. The connector of claim 1, wherein at least one of the pressing portion and the pressure receiving portion has an inclined surface inclined with respect to a moving direction of the detector and configured to gradually displace the lock arm in the direction to increase the locking margin with the lock by sliding on contact.

3. The connector of claim 2, wherein two of the pressure receiving portions are provided on opposite widthwise sides of the lock arm and two of the pressing portions are provided on opposite widthwise end sides of the detector where a direction orthogonal to a connecting direction of the two housings, is a width direction.

* * * * *